US006837556B1

(12) United States Patent
Hendy

(10) Patent No.: US 6,837,556 B1
(45) Date of Patent: Jan. 4, 2005

(54) METHOD AND KIT FOR CONSTRUCTING A CABINET

(76) Inventor: Kenneth W Hendy, 727 Wisconsin Ave., Lansing, MI (US) 48915

( * ) Notice: Subject to any disclaimer, the term of this patent is extended or adjusted under 35 U.S.C. 154(b) by 32 days.

(21) Appl. No.: 10/180,450

(22) Filed: Jun. 26, 2002

Related U.S. Application Data

(60) Provisional application No. 60/301,379, filed on Jun. 27, 2001.

(51) Int. Cl.[7] ..... A47B 47/00
(52) U.S. Cl. ..... 312/257.1
(58) Field of Search ..... 312/114, 140, 312/263, 265.1, 265.2, 265.3, 265.4, 265.5, 257.1, 110, 111

(56) References Cited

U.S. PATENT DOCUMENTS 1,151,788 A * 8/1915 Hotz ..... 312/114
1,828,088 A 10/1931 Robinson
1,973,871 A * 9/1934 Hoeggar ..... 312/227
2,158,291 A * 5/1939 Lank ..... 52/736.1
2,895,224 A 7/1959 Jones
3,181,923 A * 5/1965 Giullon et al. ..... 312/351.3
4,553,680 A 11/1985 Griggs et al.
4,786,122 A * 11/1988 Nichoalds ..... 312/257.1
5,716,116 A * 2/1998 Carlson et al. ..... 312/280
6,065,407 A * 5/2000 Wang ..... 108/147.13
6,550,880 B2 * 4/2003 Reuter ..... 312/265.3

* cited by examiner

*Primary Examiner*—Janet M. Wilkens
(74) *Attorney, Agent, or Firm*—Mary M. Moyne; Ian C. McLeod

(57) ABSTRACT

A cabinet and a method and kit for constructing a cabinet (10, 210, 310). The cabinet includes a top plate (12, 312), a bottom plate (16, 216, 316), side or corner panels (20, 220, 320) and rods (22, 222, 322). The components of the cabinet can be provided in a kit along with fasteners (24) to secure the components together and covers to hide the ends of the fasteners. The top and bottom plates have holes (14, 18, 318) which accommodate the ends (22A, 322A, 22B, 322B) of the rods. The panels have curved surfaces (20F, 220F, 320F) along their sides which engage the outer surface (22C, 222C, 322C) of the rods. The connection of the rods and the panels provides a finished appearance to the cabinet.

26 Claims, 6 Drawing Sheets

METHOD AND KIT FOR CONSTRUCTING A CABINET

CROSS-REFERENCE TO RELATED APPLICATIONS

This application claims the benefit of U.S. Provisional Application No. 60/301,379, filed Jun. 27, 2001.

STATEMENT REGARDING FEDERALLY SPONSORED RESEARCH OR DEVELOPMENT

Not Applicable

BACKGROUND OF THE INVENTION (1) Field of the Invention

The present invention relates to a cabinet and a method and kit for constructing the cabinet. In particular, the present invention relates to a method and kit for constructing a cabinet which uses a plurality of side panels positioned between top and bottom plates and connected together along their sides by rods.

(2) Description of the Related Art

The related art has shown various types of cabinets and methods for constructing the cabinets. Illustrative are U.S. Pat. No. 1,828,088 to Robinson; U.S. Pat. No. 2,895,224 to Jones; and U.S. Pat. No. 4,553,680 to Griggs et al.

Robinson shows a container having an upper plate and a lower plate with four (4) plate-like side members. The corners of the container are formed by posts. The posts have a cylindrical portion with a pair of flanges on each side. The cylindrical portion and the flanges form U-shaped recesses into which the side members are inserted.

Jones shows a supporting framework constructed of interconnecting tubes. Some of the tubes are connected together by a ball type joint which allows the tubes to be positioned during assembly.

Griggs et al. shows a display case having four side panels, a top panel and a bottom panel. Rod-like securing members are positioned at the corners. The rod-like members have a diameter substantially the same as the width of the side panels. The rod-like members are essentially in an abutting relationship with the vertical edges of the side panels.

There remains a need for an easy to assemble cabinet where the sides of the side panels have curved surfaces which engage rods to provide a finished appearance.

SUMMARY OF THE INVENTION

A cabinet and a method and kit for constructing a cabinet. The cabinet includes a top plate, a bottom plate, side or corner panels and rods. The components of the cabinet can be provided in a kit along with fasteners to secure the components together and covers to hide the ends of the fasteners. The method of constructing the cabinet is very easy and the resulting cabinet is aesthetically pleasing. The top and bottom plates can be of any shape and size. The top and bottom plates have holes which accommodate the ends of the rods. The panels have curved surfaces along their sides which engage the outer surface of the rods. The connection and positioning of the rods and the panels provides a finished appearance to the cabinet. To construct the cabinet, the second ends of the rods are inserted into the holes in the bottom plate. Next, in one (1) embodiment, the top plate is positioned on the first ends of the rods such that the first ends of the rods extend into the holes in the top plate. The rods extend perpendicular to the top and bottom plates between the plates. The plates are preferably spaced apart and parallel to each other. Next, the panels are inserted between the rods. In another embodiment, one (1) panel is positioned adjacent each rod. In this embodiment, the panels have slots extending parallel to the rods. Inserts are positioned in the slots and extend between adjacent corner panels. The panels are positioned between the top and bottom plates perpendicular to the plates with the curved surfaces along the sides of the panels in contact with the outer surface of the rods. The top plate is then moved toward the bottom plate to sandwich the panels between the plates. In one (1) embodiment, the rods, panels and inserts are first positioned on the bottom plate and then the top plate is positioned on the rods. The first end of the rods may extend above the top plate and a cap may be placed on the first ends of the rods. The top plate may have a center opening to allow access to the interior of the opening. The panels may or may not be positioned around the entire perimeter of the top and bottom plates. A face panel for mounting a clock mechanism may be included to allow use of the cabinet as a clock cabinet. The cabinet can have a variety of shapes and sizes depending on the use of the cabinet. The cabinet can be used as a cabinet for a clock. It can be used as an article holder or vase. It can be used as a pedestal for a work surface. It can also be used as a pillar or column for a structure.

The present invention relates to a cabinet which comprises a first plate having two or more first holes; rods with opposed first and second ends having an outer surface with a curvature essentially constant along a length of the rods between the ends with the first ends of the rods mounted in the first holes in the first plate; a second plate having two or more second holes and mounted such that the second ends of the rods extend into the second holes in the second plate; and two or more panels having a first end and a second end with a curved side extending between the ends, wherein a curvature of the curved side is substantially similar to the constant curvature of the outer surface of the rods, wherein the panels are mounted between the first and second plates such that the first ends of the panels are adjacent the first plate, the second ends of the panels are adjacent the second plate and the curved side of the panels are adjacent the rods.

Further, the present invention relates to a kit for constructing a cabinet which comprises a first plate having two or more first holes; a second plate having two or more second holes; two or more rods having opposed first and second ends with an outer surface having a curvature essentially constant along a length of the rods between the ends; and two or more panels having first and second ends with a curved side extending between the ends wherein a curvature of the curved side is substantially similar to the curvature of the outer surface of the rods.

Still further, the present invention relates to a method for constructing a cabinet which comprises the steps of providing a kit having a first plate with first holes and a second plate with second holes, rods having opposed first and second ends with an outer surface having a curvature essentially constant along a length of the rods between the ends and panels having opposed first and second ends with a curved side extending between the first and second ends wherein the curvature of the outer-surface of the rods is substantially similar to a curvature of the curved side of the panels; inserting the first end of the rods in the first holes in the first plate; inserting the second end of the rods in the second holes in the second plate; positioning the panels between the first and second plates such that the first ends of the panels are adjacent the first plate, the second ends of the panels are adjacent the second plate and the curved sides are adjacent one of the rods; and moving the first plate toward the second plate along the rods such that the first ends of the panels are in contact with the first plate and the second end of the panels are in contact with the second plate.

Further still, the present invention relates to a method for constructing a cabinet which comprises the steps of providing a kit having a first plate with first holes and a second plate with second holes, rods having opposed first and second ends with an outer surface having a curvature essentially constant along a length of the rods between the ends and panels having opposed first and second ends with a curved side extending between the first and second ends wherein the curvature of the outer surface of the rods is substantially similar to a curvature of the curved side of the panel; inserting the second ends of the rods into the second holes in the second plate; positioning the panels such that the second ends of the panels are adjacent the second plate and the curved sides of the panel are adjacent one of the rods; inserting the first ends of the rods into the first holes of the first plate; and moving the first plate toward the second plate along the rods.

The substance and advantages of the present invention will become increasingly apparent by reference to the following drawings and the description.

BRIEF DESCRIPTION OF THE DRAWING(S)

Figure 3:
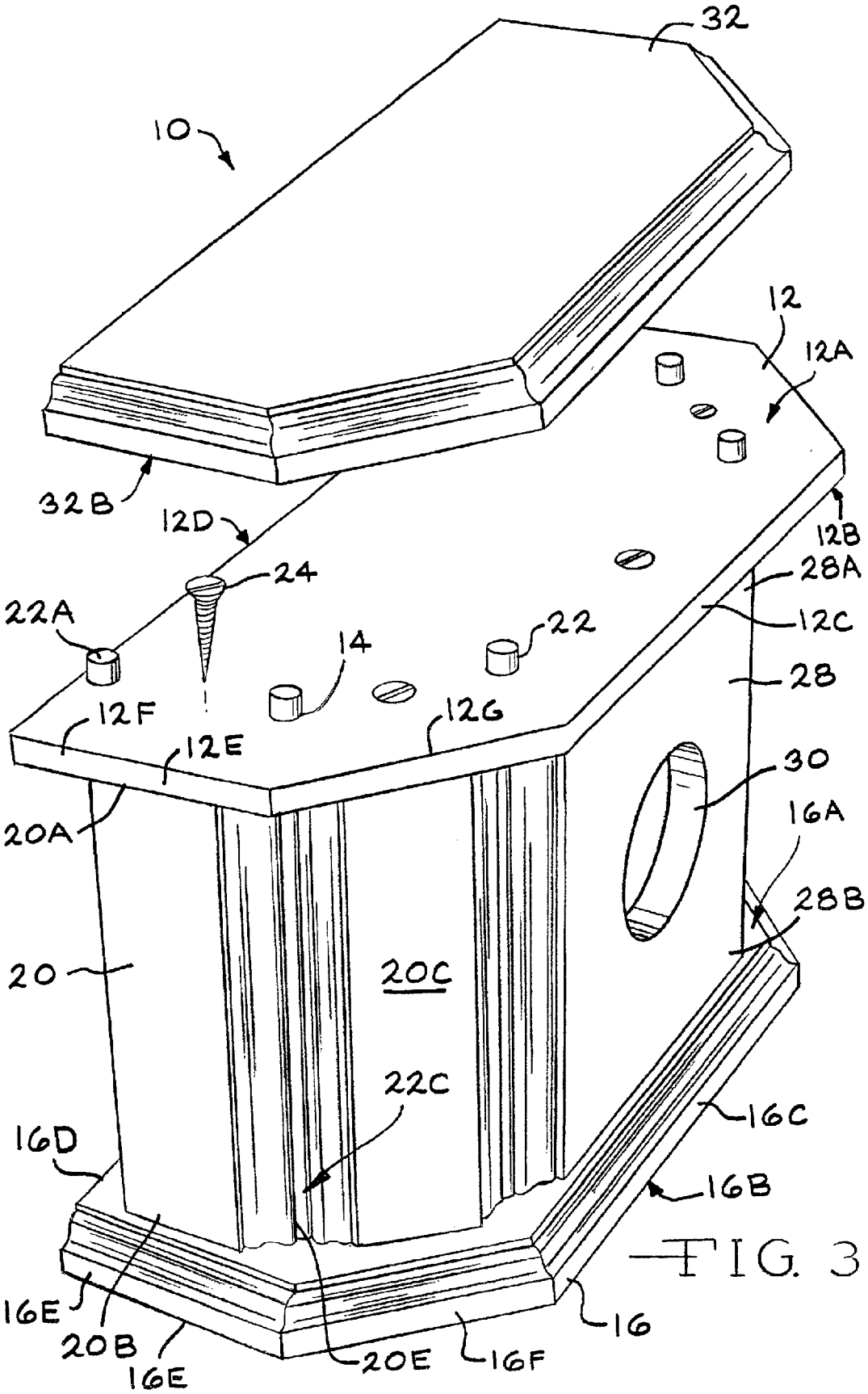

FIG. 3 is a perspective view of the clock cabinet 10 showing the fasteners 24 and the rods 22 extending above the top plate 12.

Figure 4:
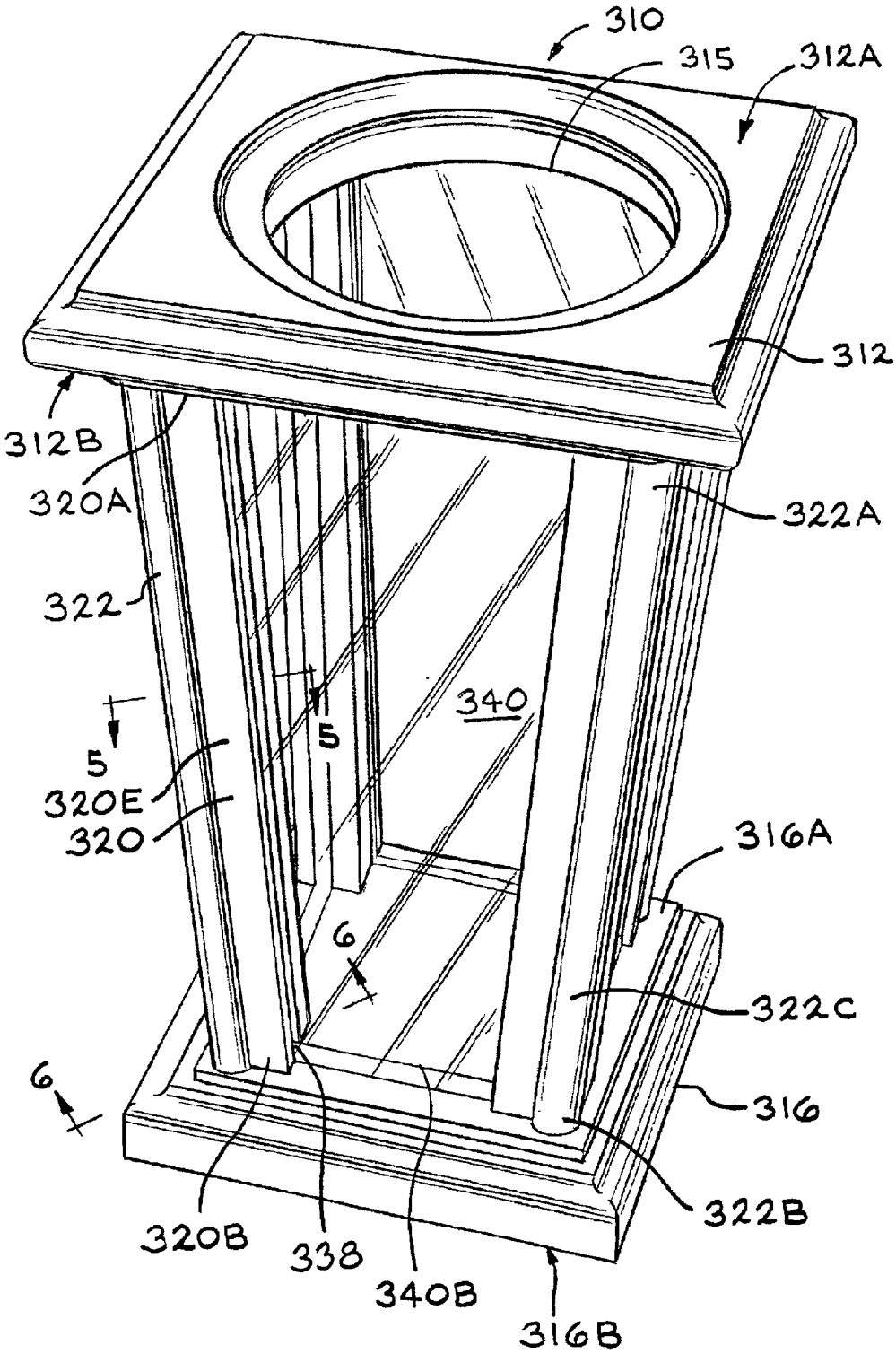

FIG. 4 is a perspective view of the vase cabinet 310.

Figure 5:
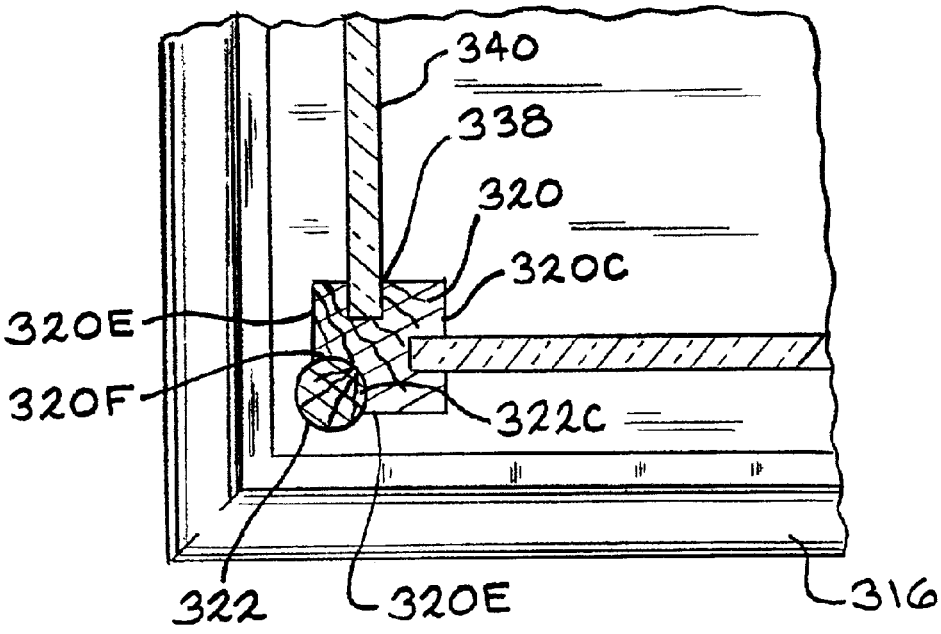

FIG. 5 is a cross-sectional view along line 5—5 of FIG. 4 showing the rod 322 and the corner panel 320.

Figure 6:
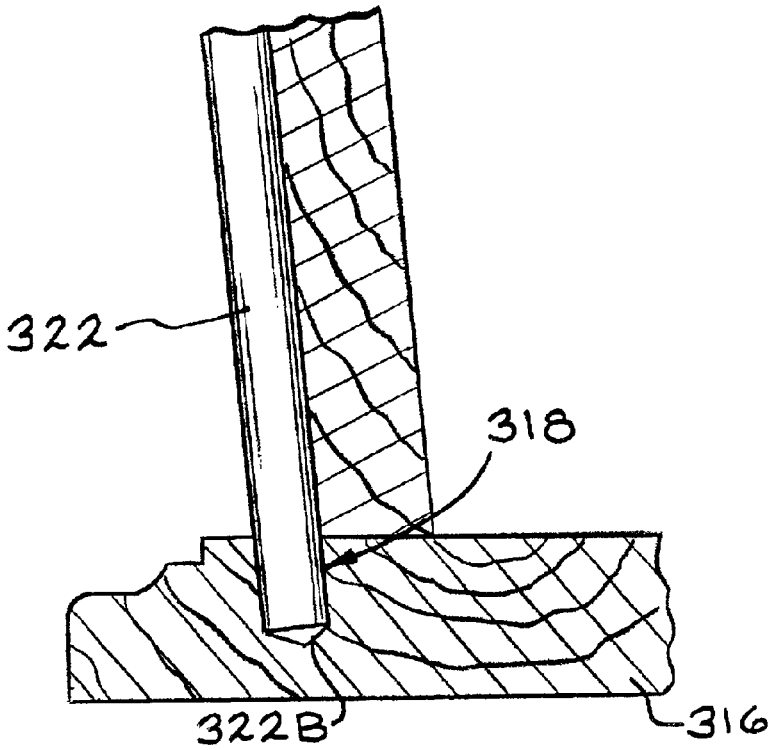

FIG. 6 is a cross-sectional view along the line 6—6 of FIG. 4 showing the second end 322B of the rod 322 inserted at an angle into the bottom plate 316 of the vase cabinet 310.

Figure 7:
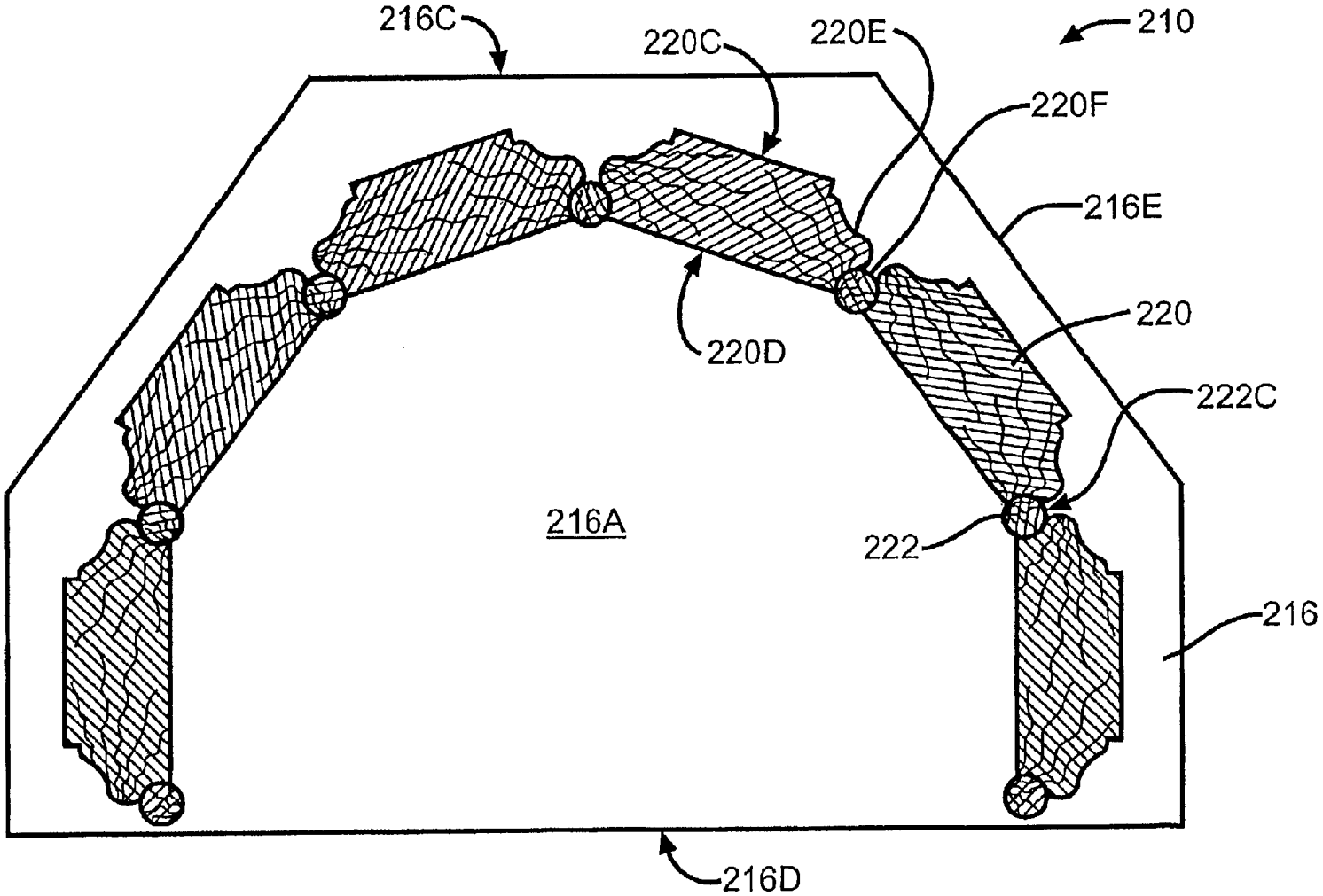

FIG. 7 is a top view of a pedestal cabinet 210 without the top plate or work surface.

DESCRIPTION OF THE PREFERRED EMBODIMENT(S)

The present invention is a cabinet 10, 210 or 310 and a method and kit for constructing the cabinet 10, 210 or 310. The components of the cabinet 10, 210 or 310 includes a first or top plate 12 or 212, a second or bottom plate 16, 216 or 316, side or corner panels 20, 220 or 320 and rods 22, 222 or 322. In one (1) embodiment, the cabinet 10 includes a cap 32. In another embodiment, the cabinet 310 includes inserts 340. The cabinet 10, 210 or 310 can have a variety of sizes and shapes depending on the use for the cabinet 10, 210 or 310. The size and shape of the top and bottom plates 12, 212, 16, 216, and 316 and the side or corner panels 20, 220 or 320 depends on the use of the cabinet 10, 210 and 310. The number of side panels 20, 220 or 320 depends on the size of the side panels 20, 220 or 320 and the size of the cabinet 10, 210 or 310. The number of rods 22, 222 or 322 depends on the number of side panels 20, 220 or 320.

The top plate 12 or 312 has a top side 12A or 312A and a bottom side 12B or 312B with a front edge 12C or 312C, a back edge 12D or 312D and side edges 12E or 312E extending therebetween. In one (1) embodiment, the top plate 312 has a square shape and the edges 312C, 312D and 312E are identical. The top plate 12 or 312 has holes 14 in the bottom side 12B or 312B adjacent the perimeter of the top plate 12 or 312. In one (1) embodiment, the holes 14 extend completely through the top plate 12 or 312. In one embodiment, the holes 14 do not extend along the back edge 12D of the top plate 12. The bottom plate 16, 216 or 316 has a top side 16A, 216A or 316A and a bottom side 16B or 316B with a front edge 16C, 216C or 316C, a back edge 16D, 216D or 316D and side edges 16E, 216E or 316E extending therebetween. In one (1) embodiment, the bottom plate 316 has a square shape and the edges 316C, 316D and 316E are identical. The top side 16A, 216A or 316A of the bottom plate 16 or 216 or 316 is provided with holes 18 or 318 adjacent the perimeter of the bottom plate 16, 216 or 316. In one (1) embodiment, the holes 18 or 318 do not extend completely through the bottom plate 16, 216 or 316. In one (1) embodiment, the holes 18 do not extend along a back edge 16D or 316D of the bottom plate 16 or 316. The holes 14, 18 or 318 in the top and bottom plates 12, 312, 16, 216, or 316 are located wherever a panel 20, 220 or 320 is positioned.

The side or corner panels 20, 220, 320 have a first or top end 20A or 320A and a second or bottom end 20B or 320B with a front 20C, 220C or 320C and a back 20D, 220D or 320D and two (2) sides 20E, 220E or 320E extending between the ends 20A, 320A, 20B or 320B. In one (1) embodiment, a portion of both sides 20E or 220E is curved or has a curved surface. In another embodiment, a portion of only one of the sides 320E is curved or has a curved surface. The rods 22, 222 or 322 have a first end 22A or 322A and a second end 22B or 322B with a curved outer surface 22C, 222C or 322C. In one (1) embodiment, the rods 22, 222 or 322 have a cylindrical shape with a constant diameter throughout their length between the ends 22A, 322A, 22B or 322B. In another embodiment, only a portion of the rods has a constant diameter with the ends of the rods having a different diameter. The diameter of the holes 14 in the top plate 12 or 212 are substantially equal to or slightly greater than the diameter of the rods 22, 222 or 322 at the first end 22A or 322A. The diameter of the holes 18 or 318 in the bottom plate 16, 216 or 316 are substantially equal to or slightly greater than the diameter of the rods 22, 222 or 322 at the second end 22B or 322B. The rods 22, 222 or 322 have a length between the ends 22A, 322A, 22B or 322B greater than the length of the side or corner panels 20, 220 or 320 between the ends 20A, 320A, 20B or 320B. The components to construct the cabinet 10, 210 or 310 can be provided in a kit. The kit can include fasteners 24 to secure the top and bottom plates 12, 212, and 16, 216 or 316 and side or corner panels 20, 220 or 320 together. The kit can include covers (not shown) to hide the fasteners 24. In one (1) embodiment, the top plate 12 or 212, bottom plate 16, 216 or 316, side or corner panels 20, 220 or 320 and rods 22, 222 or 322 of the kit are unfinished and can be finished in any coat as desired by the user.

Figure 1:
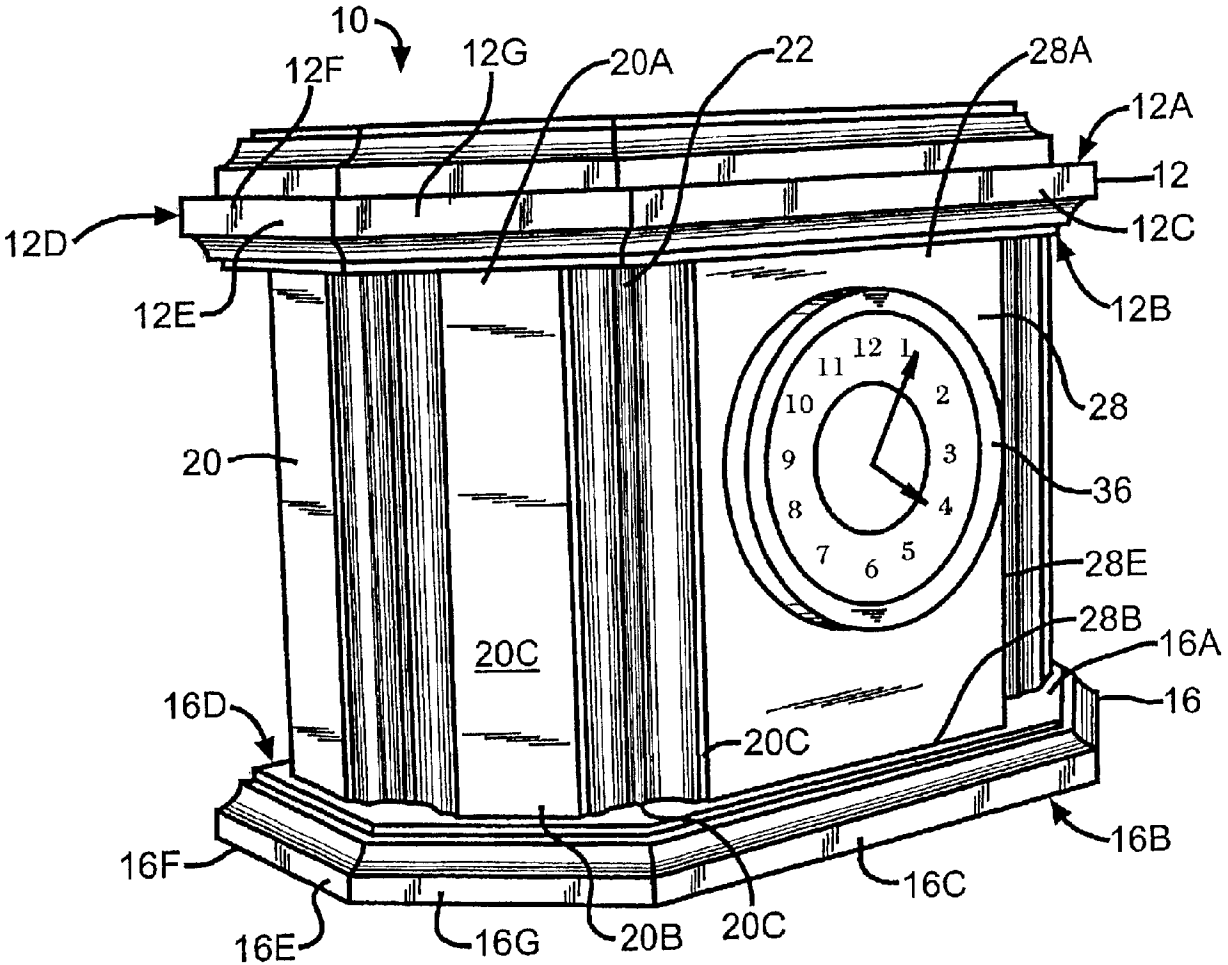
FIG. 1 is a perspective view of a clock cabinet 10.
Figure 2:
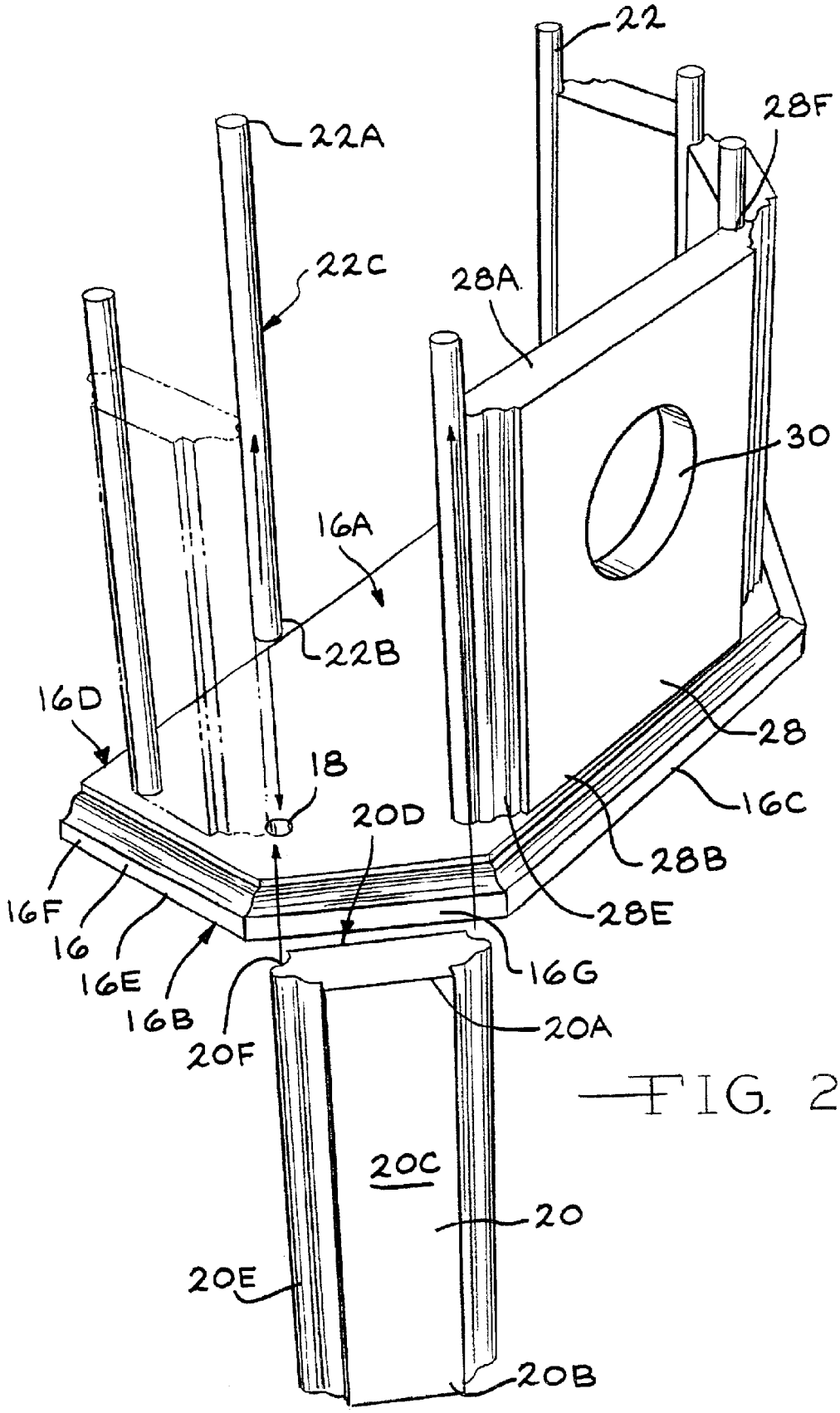
FIG. 2 is a view of the clock cabinet 10 partially constructed without the top plate 12.

In a first example, the cabinet 10 is a clock cabinet 10 (FIGS. 1 to 3). The cabinet 10 includes a top plate 12, a bottom plate 16, side panels 20, a face panel 28, a cap 32 and a clock mechanism 36. In this embodiment, the top and bottom plates 12 and 16 have the same shape. The side edges 12E and 16E of the top and bottom plates 12 and 16 are angled between the front and back edges 12C, 16C and 12D, 16D. The angled side edges 12E and 16E of the top and bottom plates 12 and 16 include a first section 12F and 16F and a second section 12G and 16G. The top and bottom plates 12 and 16 have holes 14 and 18 along the front edges 12C and 16C and side edges 12E and 16E but do not have holes 14 or 18 along the back edges 12D or 16D. In this example, a portion of both sides 20E of the side panels 20 are provided with curved surfaces 20F extending the entire length of the side panels 20 between the ends 20A and 20B. The curved surface 20F is adjacent the back 20D of the side panel 20. The remaining portion of the sides 20E of the side panels 20 can be provided with a design or any other varied surface which is aesthetically pleasing. The side panels 20 are preferably all identical. The rods 22 are preferably cylindrical with a constant diameter between the ends 22A and 22B. The outer surface 22C of the rods 22 has a constant curvature between the ends 22A and 22B. The number of side panels 20 and the number of rods 22 depends on the size of the clock cabinet 10. In one (1) embodiment, there are four (4) side panels 20 and six (6) rods 22. The face panel 28 is preferably similar in shape to the side panels 20. The face panel 28 is provided with an indentation 30 into which is inserted the clock mechanism 36 (FIG. 1). The face panel 28 is preferably greater in width between the opposed sides 28E than the side panels 20. To construct the clock cabinet 10, the bottom plate 16 is positioned bottom side 16B down. The second ends 22B of the rods 22 are inserted into the holes 18 in the top side 16A of the bottom plate 16. In one (1) embodiment, the diameter of the second ends 22B of the rods 22 in only slightly less that the diameter of the holes 18 in the bottom plate 16 such that the second ends 22B of the rods 22 are force fit into the holes 18 in the bottom plate 16. The second ends 22B of the rods 22 may also be secured in the holes 18 in the bottom plate 16 using an adhesive. Next, the first ends 22A of the rods 22 are inserted into the holes 14 in the bottom side 12B of the top plate 12. The holes 14 extend completely through the top plate 12. The side panels 20 are then inserted between the top and bottom plates 12 and 16 and between the rods 22. The side panels 20 are positioned such that the second or bottom ends 20B of the side panels 20 are adjacent the top side 16A of the bottom plate 16. The side panels 20 are positioned such that the rods 22 are adjacent and in contact with the curved surfaces 20F of the sides 20E of the side panels 20. Adjacent side panels 20 are positioned at an angle to each other spaced apart about the outer surface 22C of the shared rod 22. The side panels 20 are not positioned along the back or front edges 12C, 12D or 16C, 16D of the top and bottom plates 12 and 16. The face plate 28 is positioned between the rods 22 adjacent the front edge 12B and 16B of the top and bottom plates 12 and 16 and extends across the front edge 12B and 16B of the top and bottom plates 12 and 16. The rods 22 on the side edges 12E and 16E of the top and bottom plates 12 and 16 adjacent the back edge 12D and 16D of the top and bottom plates 12 and 16 are spaced apart from the back edge 12D and 16D of the top and bottom plate 12 and 16. The rods 22 are positioned at the point where the first section 12F and 16F contacts the back edge 12D and 16D of the top and bottom plates 12 and 16, where the first and second sections 12F, 16F, 12G and 16G meet, and where the second section 12G and 16G meets the front edge 12C and 16C of the top and bottom plates 12 and 16. The side panels 20 are of a width between the sides 20E such that one (1) side panel 20 extends across each of the first and second sections 12F, 16F, 12G and 16G of the sides edges 12E and 16E of the top and bottom plates 12 and 16. Once the side and face panels 20 and 28 are in position, the top plate 12 is moved downward on the rods 22 until the bottom side 12B of the top plate 12 is in contact with the first or top ends 20A and 28A of the side and face panels 20 and 28. The diameter of the first ends 22A of the rods 22 is less than the diameter, of the holes 14 in the top plate 12 such that the rods 22 can be inserted completely through the top plate 12. When the top plate 12 is in position, the first ends 22A of the rods 22 extend above the top side 12A of the top plate 12 (FIG. 3). In one (1) embodiment, the first ends 22A of the rods 22 extend above the top side 12A of the top plate 12 about 0.375 inches (0.953 cm). Next fasteners 24 are inserted through the top and bottom plates 12 and 16 into the top and bottom ends 20A, 20B, 28A and 28B of the side and face panels 10 and 28. In one (1) embodiment, the fasteners 24 are wood screws. The cap 32 is then mounted over the top plate 12 such that the first ends 22A of the rods 22 extend into the holes (not shown) in the bottom side 32B of the cap 32. The holes in the cap 32 do not extend completely through the cap 32. In one (1) embodiment, the cap 32 has the same shape as the top and bottom plates 12 or 16 but is slightly smaller in size. The cap 32 is of such a size as to cover the fasteners 24. The first ends 22A of the rods 22 can be secured in the holes in the cap 32 such as by an adhesive. A covering (not shown) can be mounted on the bottom side 16B of the bottom plate 16 to cover the fasteners 24. When the cabinet is correctly constructed, the rods 22 and the panels 20 and 28 are perpendicular to the top and bottom plates 12 and 16. The top and bottom plates 12 and 16 are parallel to each other. In this embodiment, the back of the cabinet 10 is open. It is understood that the side and face panels 20 and 28 can have a variety of shapes and designs providing that a portion of the sides 20E and 28E have a curved surface 20F and 28F which accommodates the outer surface 22C of the rods 22. The curvature of the curved surface 20F and 28F of the sides 20E and 28E of the side and face panels 20 and 28 is essentially similar to the curvature of the outer surface 22C of the rods 22 such that a portion of the length of the rods 22 between the ends 22A and 22B can fully contact the curved surface 20F and 28F of the sides 20E and 28E of the panels 20 and 28. The curved surface 20F and 28F extends the entire length of the side and face panels 20 and 28 between the ends 20A, 20B, 28A and 28B of the panels 20 and 28. The size of the curved surface 20F and 28F of the panels 20 and 28 is such that only a portion of the outer surface 22C of the rod 22 is in contact with the curved surface 20F and 28F. Thus a portion of the outer surface 22C of the rod 22 is visible between the panels 20 and 28.

In a second example, the cabinet 210 is used to provide a pedestal 210 for a work surface (FIG. 7). In this example, the top plate (not shown), bottom plate 216, side panels 220 and rods 222 are similar to the top plate 12, bottom plate 16, side panels 20 and rods 22 of the first example. However, it is understood that the plates 216 and side panels 220 could have any shape or size. In this example, the first ends (not shown) of the rods 222 do not extend above the top side of the top plate. Preferably, the first ends of the rods 222 are flush with the top side of the top plate. The top side of the top plate can be the work surface. In another embodiment, the work surface is mounted on the top side of the top plate. The side panels 220 extend around the side edges 212E and front edges 212C of the top and bottom plates 216. As in the first example, the back of the pedestal cabinet 210 is open. This pedestal cabinet 216 is constructed similarly to the clock cabinet 10 of the first embodiment. With the outer surface 222C of the rods 222 extending along and in contact with the curved surfaces 200F on both sides of 220E of the panels 222.

In the third embodiment, the cabinet 310 is used as a vase. The vase cabinet 310 includes a top plate 312, a bottom plate 316, four (4) corner panels 320, four (4) rods 322 and four (4) side inserts 340. The bottom plate 316 can be of any size or shape. In the preferred embodiment, the bottom plate 316 is square. The bottom plate 316 has four (4) holes 318 in the top side 316A adjacent each of the corners of the bottom plate 316. The holes 318 do not extend completely through the bottom plate 316. The top plate 312 is preferably the same shape as the bottom plate 316 and has a center opening 315. The top plate 312 has holes (not shown) in the bottom side 312B. Preferably, the holes do not extend completely through the top plate 312. In one (1) embodiment, the top plate 312 is larger than the bottom plate 316. In this embodiment, the holes 318 in the top and bottom plates 312 and 316 are angled (FIG. 6). The corner panels 320 have a first or top end 320A and a second or bottom end 320B with four (4) sides 320C and 320E. The corner panels 320 preferably have a square cross-section. The first and second sides 320C of the corner panels 320 are adjacent each other and have slots 338 extending the complete length of the corner panels 320 between the ends 320A and 320B. The width of the slots 338 is slightly greater than the thickness of the sides 340C of the inserts 340. The corners formed by the third and fourth sides 320E of the corner panels 320 have an groove having a curved surface 320F (FIG. 7). The rods 322 are preferably similar to the rods 22 and 222 of the first and second embodiments. The outer surface 322C of the rods 322 has a constant curvature between the ends 322A and 322B. The curvature of the curved surface 320F is similar to the curvature of the outer surface 322C of the rods 322. In one (1) embodiment, the curved surface 320F is semi-circular such that half of the outer surface 322C of the rods 322 is contacted by the curved surface 320F.

To construct the vase cabinet 310, the second ends 322B of the rods 322 are inserted into the holes 318 in the top side 316A of the bottom plate 316 (FIG. 6). Next, the corner panels 320 are positioned adjacent the rods 322 such that the rods 322 are adjacent and in contact with the curved surface 320F extending along the corner of the corner panel 320 between the third and fourth sides 320E. The corner panels 320 can be secured in place by fasteners (not shown) inserted from the bottom plate 316 through the second or bottom end 320B of the corner panels 320. The corner panels 320 could also be secured in place using an adhesive. Next, the inserts 340 are inserted between adjacent corner panels 320 such that the bottom edge 340B of the insert 340 is adjacent the bottom plate 316 and the sides 340C of the inserts 340 are in the slots 338 of the corner panels 320. In one (1) embodiment, the inserts 340 are transparent to allow for viewing the interior of the vase cabinet 310. In another embodiment, a second decorative surface (not shown) is placed adjacent an inside surface of the insert 340. Once the inserts 340 are in place, the top plate 312 is mounted on the first ends 322A of the rods 322. In the embodiment where the top plate 312 is greater in size than the bottom plate 316, the rods 322 extend upward at an angle and the vase cabinet 310 has a truncated triangular shape (FIG. 4). The center opening 315 in the top plate 312 allows access to the interior of the vase cabinet 310 such as to insert flowers.

In another example (not shown), the cabinet is used as a pillar or column such as for a porch or is used as an interior, decorative pillar. In this embodiment, the top and bottom plates have the same size and shape. The side panels are all identical and are located along all edges around the perimeter of the top and bottom plates. In this example, the pillar is constructed similar to the second example showing the pedestal.

It is intended that the foregoing description be only illustrative of the present invention and that the present invention be limited only by the hereinafter appended claims.

I claim:

1. A cabinet which comprises:

a) a first plate having two or more first holes;

b) rods with opposed first and second ends having an outer surface with a curvature essentially constant along a length of the rods between the ends with the first ends of the rods mounted in the first holes in the first plate;

c) a second plate having two or more second holes and mounted such that the second ends of the rods extend into the second holes in the second plate; and d) two or more panels having a first end and a second end with a curved side extending between the ends, wherein a curvature of the curved side is substantially similar to the constant curvature of the outer surface of the rods, wherein the panels are mounted between the first and second plates such that the first ends of the panels are adjacent the first plate, the second ends of the panels are adjacent the second plate and the curved side of the panels are adjacent the rods so that a portion of the outer surface of the rods adjacent a front of the panels is visible.

2. The cabinet of claim 1 wherein the first plate is parallel to the second plate.

3. The cabinet of claim 2 wherein the rods are perpendicular to the first and second plates.

4. The cabinet of claim 1 wherein the rods include a first rod and the panels include a first panel and a second panel, wherein each panel has a first curved side and a second curved side extending between the ends and wherein the first panel is mounted such that the second curved side is adjacent the first rod and the second panel is mounted such that the first curved side is adjacent the first rod.

5. The cabinet of claim 4 wherein the first panel is mounted at an angle to the second panel.

6. The cabinet of claim 4 wherein the rods include a second rod and the panels include a third panel having a first curved side and a second curved side extending between the ends and wherein the second panel is mounted such that the second curved side is adjacent the second rod and the third panel is mounted such that the first curved side is adjacent the second rod.

7. The cabinet of claim 1 wherein the holes in the first plate extend completely through the first plate and wherein the first ends of the rods extend completely through the first plate.

8. The cabinet of claim 7 wherein a cap is mounted on the first ends of the rods which extend through the first holes in the first plate.

9. The cabinet of claim 1 wherein the panels include a face panel and wherein the face panel has an indentation which is configured to accommodate a clock mechanism.

10. The cabinet of claim 1 wherein the rods extend at an angle between the first and second plates.

11. The cabinet of claim 1 wherein the panels have slots extending between the ends.

12. The cabinet of claim 11 wherein the panels include a first panel and a second panel, wherein the rods include a first rod and a second rod, wherein the first panel is mounted such that the curved side of the first panel is adjacent the first rod and the second panel is mounted such that the curved side of the second panel is adjacent the second rod, wherein the first and second panels are mounted such that the slot of the first panel is aligned with the slot of the second panel, and wherein an insert having a first side and a second side is positioned between the first and second panel such that the first side is positioned in the slot of the first panel and the second side is positioned in the slot of the second panel.

13. The cabinet of claim 1 wherein the first holes are located adjacent a perimeter of the first plate.

14. The cabinet of claim 13 wherein the second holes of the second plate are located around a perimeter of the second plate.

15. The cabinet of claim 1 wherein the first and second plates are essentially identical in shape and size and the first holes are provided around an entire perimeter of the first plates and the second holes are provided around an entire perimeter of the second plate and the cabinet is used as a pillar.

16. A kit for constructing a cabinet which comprises:

a) a first plate having two or more first holes;

b) a second plate having two or more second holes;

c) two or more rods having opposed first and second ends with an outer surface having a curvature essentially constant along a length of the rods between the ends; and d) two or more panels having a front and a back and having first and second ends with a side extending between the ends and between the front and the back wherein one of the panels is a face panel having an indentation configured to accommodate a clock mechanism, wherein a portion of the side is curved and wherein a curvature of the portion is substantially similar to the curvature of the outer surface of the rods.

17. The kit of claim 16 wherein fasteners are provided for connecting the first and second plates to the panels.

18. The kit of claim 16 wherein an adhesive is provided for securing the rods in the first and second holes of the first and second plates.

19. The kit of claim 16 wherein the first holes in the first plate extend completely through the first plate and wherein a cap having holes is provided for covering the first holes in the first plate.

20. A method for constructing a cabinet which comprises the steps of:

a) providing a kit having a first plate with first holes and a second plate with second holes, rods having opposed first and second ends with an outer surface having a curvature essentially constant along a length of the rods between the ends and panels having a front and a back and having opposed first and second ends with a side extending between the first and second ends and between the front and the back wherein a portion of the side is curved and wherein the curvature of the outer surface of the rods is substantially similar to a curvature of the portion of the side of the panels;

b) inserting the first end of the rods in the first holes in the first plate;

c) inserting the second end of the rods in the second holes in the second plate;

d) positioning the panels between the first and second plates such that the first ends of the panels are adjacent the first plate, the second ends of the panels are adjacent the second plate and the curved sides are adjacent one of the rods and so that a portion of the outer surface of the rods adjacent the front of the panels is visible; and e) moving the first plate toward the second plate along the rods such that the first ends of the panels are in contact with the first plate and the second end of the panels are in contact with the second plate.

21. The method of claim 20 wherein fasteners are provided in the kit and wherein after step e), fasteners are inserted through the first plate into the first ends of the panels and fasteners are inserted through the second plate into the second ends of the panels to secure the panels in position between the first and second plates.

22. The method of claim 20 wherein the first holes in the first plate extend completely through the first plate and wherein in step e), the first plate is moved toward the second plate until the first ends of the rods extend outward from the first plate on a side opposite the second plate, wherein a cap having holes is provided and wherein the cap is mounted on the first ends of the rods adjacent the first plate on the side opposite the second plate.

23. The method of claim 20 wherein the panels have slots extending between the ends, wherein the kit has inserts having a thickness slightly less than a width of the slots, wherein in step c), the panels are positioned such that the slots of adjacent panels are aligned and wherein after step c), the inserts are positioned in the slots between adjacent panels.

24. A method for constructing a cabinet which comprises the steps of:

a) providing a kit having a first plate with first holes and a second plate with second holes, rods having opposed first and second ends with an outer surface having a curvature essentially constant along a length of the rods between the ends and panels having a front and a back and having opposed first and second ends with a side extending between the first and second ends and between the back and the front, wherein a portion of the side is curved and wherein the curvature of the outer surface of the rods is substantially similar to a curvature of the portion of the side of the panels;

b) inserting the second ends of the rods into the second holes in the second plate;

c) positioning the panels such that the second ends of the panels are adjacent the second plate and the curved sides of the panel are adjacent one of the rods;

d) inserting the first ends of the rods into the first holes of the first plate; and e) moving the first plate toward the second plate along the rods.

25. The method of claim 24 wherein fasteners are provided in the kit and wherein after step e), the fasteners are inserted through the first plate into the first ends of the panels and the fasteners are inserted through the second plate into the second ends of the panels to secure the panels in position between the first and second plates.

26. The method of claim 24 wherein the panels have slots extending between the ends, wherein the kit has inserts having a thickness slightly less than a width of the slots, wherein in step c), the panels are positioned such that the slots of adjacent panels are aligned and wherein after step c), the inserts are positioned in the slots between adjacent panels.

* * * * *